US005174532A

United States Patent [19]

Huang

[11] Patent Number: 5,174,532

[45] Date of Patent: Dec. 29, 1992

[54] LEG ASSEMBLY

[76] Inventor: Chin-Fa Huang, No. 526, Sec. 2, Chungshan Rd., Huatan Hsiang, Changhua Hsien, Taiwan

[21] Appl. No.: 755,858

[22] Filed: Sep. 6, 1991

[51] Int. Cl.[5] ..... F16M 11/20

[52] U.S. Cl. ..... 248/188.1; 248/151; 248/159; 108/153

[58] Field of Search ..... 248/188, 188.1, 151, 248/150, 152, 155.4, 159, 163.1, 165, 460, 463, 964, 432, 502; 108/153, 157; 211/105.1

[56] References Cited

U.S. PATENT DOCUMENTS

| | | | |
|---|---|---|---|
| 17,084 | 7/1906 | Spencer | 248/502 |
| 559,415 | 5/1896 | Sommerfeld | 248/150 |
| 2,410,330 | 10/1946 | Ashenfelter | 108/153 X |
| 2,599,404 | 6/1952 | McLemore | 108/153 X |
| 3,017,153 | 1/1962 | Johnson | 248/188 |
| 3,063,667 | 11/1962 | Doty, Jr. et al. | 248/150 |
| 3,082,712 | 3/1963 | Trautmann et al. | 108/153 |
| 3,339,503 | 9/1967 | Flodell | 248/188.1 X |
| 3,408,027 | 10/1968 | Price | 248/151 |
| 3,504,877 | 4/1970 | Lyon, Sr. | 248/188 |
| 3,655,159 | 4/1972 | Held, Jr. | 248/188.1 |
| 3,664,511 | 5/1972 | Fenwich | 211/105.1 |
| 3,669,392 | 6/1972 | Saunders | 248/150 X |
| 3,685,662 | 8/1972 | Varon et al. | 211/105.1 |
| 3,738,606 | 6/1973 | Millen | 248/460 X |
| 3,866,549 | 2/1975 | Berton | 248/188 X |
| 3,980,026 | 9/1976 | Thomas | 248/188.1 X |
| 3,981,251 | 9/1976 | Damberg | 248/188.1 X |
| 4,163,537 | 8/1979 | Mourgue | 248/188.1 |
| 4,944,235 | 7/1990 | Jahnke et al. | 108/157 |
| 4,966,341 | 10/1990 | Borsani | 108/153 X |
| 5,050,829 | 9/1991 | Sykes | 108/153 X |

*Primary Examiner*—Carl D. Friedman
*Assistant Examiner*—Korie Hung Chan
*Attorney, Agent, or Firm*—Gifford, Groh, Sprinkle, Patmore and Anderson

[57] ABSTRACT

A leg assembly for furniture includes horizontal and upright supports each of which has a tubular member, connectors, bases, and screw fasteners. The tubular member includes a first and an opposite second end, and a tubular wall. The tubular wall includes a first panel, an opposite second panel, a pair of opposite third panels interconnecting the first and the second panels, a pair of first longitudinal corner grooves extending between the first and second ends adjacent to the first panel, and a pair of second longitudinal corner grooves extending between the first and second ends adjacent to the second panel. The connector includes a flat panel which abuts the first end of the upright support, a pair of opposite hooking plates extending upwards from the flat panel and being curved inwardly to engage in the second corner grooves of the horizontal support. The base is connected to the second end of the upright support to uphold the upright support. The screw fastener fastens the base, the upright support, and the connector.

7 Claims, 11 Drawing Sheets

LEG ASSEMBLY

BACKGROUND OF THE INVENTION

1. Field of the Invention

This invention relates to a supporting device, more particularly to a leg assembly for furniture.

2. Description of the Related Art

Conventional home and office furniture such as partitions, desks, cabinets and the like are generally manufactured in a variety of specifications to satisfy the user's needs. The user buys furniture which has specifications suited for his house or office. Because a piece of furniture can be made into different sizes and specifications, furniture has a high manufacturing cost.

A conventional desk is generally provided with only one wire receiving space to receive the wires of electric lights, computers and the like. The wires are placed together in the wire receiving space and are easily entangled with one another.

SUMMARY OF THE INVENTION

Therefore, the objective of this invention is to provide a leg assembly for furniture. The leg assembly has a plurality of supports which are manufactured in a uniform size. Each of the supports has a plurality of wire receiving compartments to prevent electrical wires from entangling. The supports of the leg assembly can be easily cut into the desired size according to the user's needs, and the leg assembly can be conveniently assembled. The leg assembly can be provided with a glass plate, a partition plate or a drawer to serve as a desk, a partition, or a cabinet. The manufacturing cost of the leg assembly is relatively low. Therefore, the cost of a piece of furniture incorporating the leg assembly is less than that of the prior art.

Accordingly, a leg assembly for furniture of this invention includes at least one horizontal support, at least one upright support having a top and a bottom end, at least one connector connecting the top end of the upright support to the horizontal support, and at least one base connected to the bottom end of the upright support in order to uphold the upright support.

Each of the horizontal and upright supports includes a tubular member having a first end, an opposite second end, and a tubular wall extending between the first and second ends. The tubular wall includes a first panel, an opposite second panel, a pair of opposite third panels respectively interconnecting the first and second panels, a pair of first longitudinal corner grooves extending between the first and second ends adjacent to the first panel, and a pair of second longitudinal corner grooves extending between the first and second ends adjacent to the second panel. The tubular member has an interior longitudinal hollow shaft and a plurality of reinforcing webs respectively and radially connected between the hollow shaft and the tubular wall.

The first end of the upright support defines the top end of the upright support. The second end of the upright support defines the bottom end of the upright support.

The connector includes a panel which abuts the first end of the upright support and which has a hole aligned with the hollow shaft of the upright support. The connector has a pair of opposite hooking plates respectively extending upwards from the panel and being curved inwardly to engage in the second corner grooves of the horizontal support.

The leg assembly further includes at least one screw fastener. The screw fastener fastens the base, the upright support and the connector. The fastener includes a screw bolt extending from the base and passing through the hollow shaft of the upright support and the hole of the flat panel of the connector out of the flat panel of the connector.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
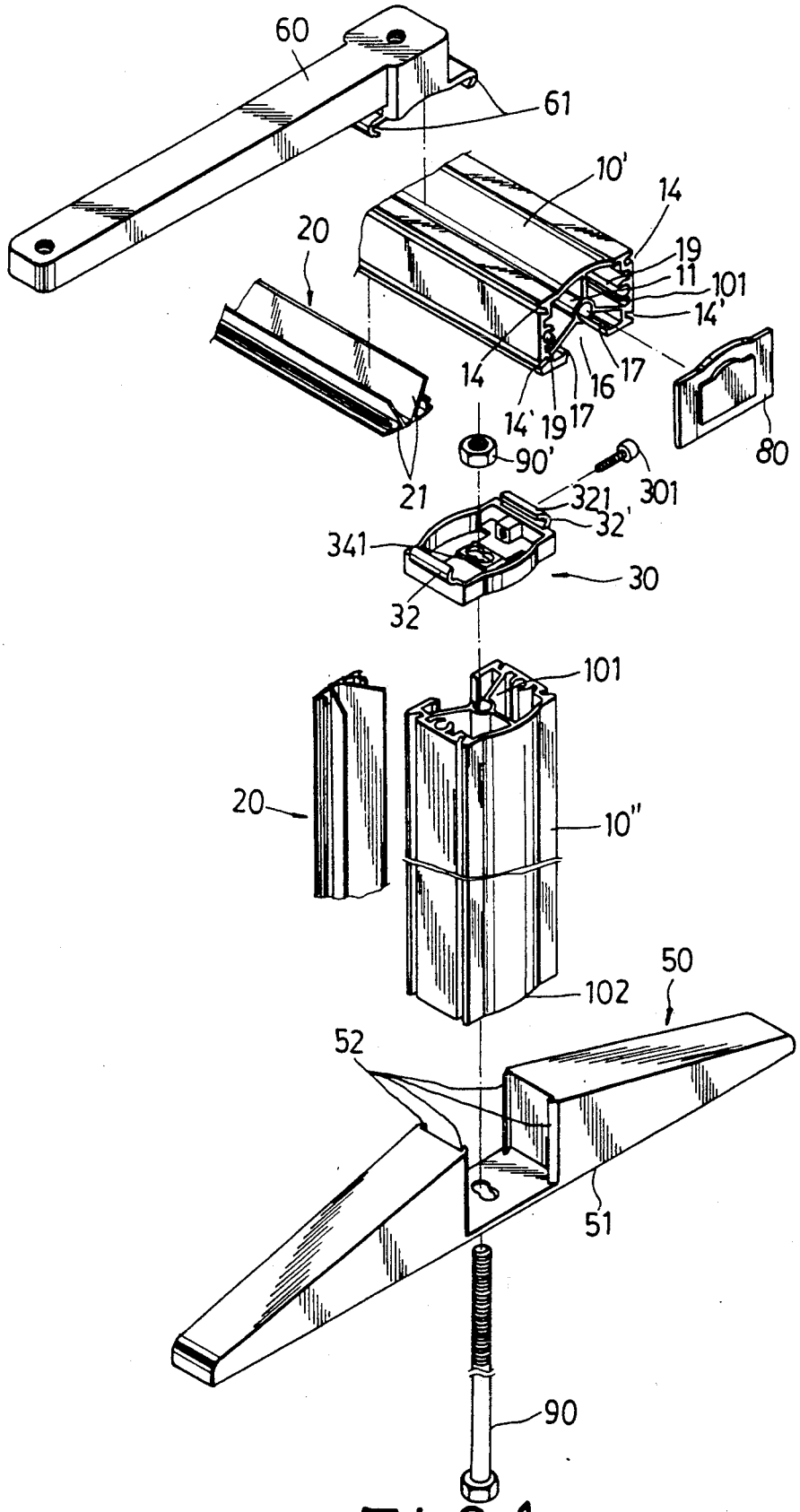
FIG. 1 is an exploded view of the preferred embodiment of the leg assembly of this invention.

Referring to FIGS. 1 to 4, a leg assembly for furniture of this invention has horizontal supports (10') and upright supports (10''). Each of the horizontal and upright supports (10', 10'') has an extruded aluminum tubular member (10) which includes a first end (101), an opposite second end (102), and a tubular wall (103) extending between the first and second ends (101, 102). The tubular wall (103) includes a first panel (18), an opposite second panel (15), a pair of opposite third panels (12) respectively interconnecting the first and second panels (18, 15), a pair of first longitudinal corner grooves (14) radially extending between the first and second ends (101, 102) adjacent to the first panel (18), and a pair of second longitudinal corner grooves (14') radially extending between the first and second ends (101, 102) adjacent to the second panel (15). The first panel (18) has a convex portion (181). The tubular member (10) has an interior longitudinal hollow shaft (11) and three reinforcing webs (11') respectively and radially connected between the hollow shaft (11) and the tubular wall (103). The second panel (15) of the tubular member (10) has a longitudinal opening (16) extending from the first end (101) to the second end (102) in order to access the interior of the tubular member (10), and a longitudinal detachable cover plate (20) to close the opening (16). The cover plate (20) is made of an insulating material such as rubber or plastic. The cover plate (20) has two partition plates (21) extending inwards therefrom to define three wire receiving compartments (24, 25, 26). Electric wires (100) of electric lights, computers and the like can be respectively placed in the wire receiving compartments (24, 25, 26) of the cover plate (20) to prevent the wires from entangling. The second panel (15) has two longitudinally spaced peripheral edges adjacent to the opening (16), each of which has an inward and longitudinal rail (17) formed therealong. The cover plate (20) has a pair of oppositely longitudinal projecting portions each of which has a longitudinal rail groove (22) formed therealong. The rail grooves (22) engage the rails (17) when the cover plate (20) closes the opening (16). The tubular member (10) has a pair of oppositely longitudinal interior C-shaped grooves (19), respectively formed along the opposite third panels (12).

The leg assembly has connectors (30) made of a metal material. Each of the connectors (30) has a cross-section substantially similar to the cross-section of the tubular member (10). The connector includes a flat panel (33) with four protrusions extending downwards therefrom, a loop-shaped peripheral flange (31) extending upwards from the flat panel (33), a hooking plate (32) extending upwards from the peripheral flange (31), and an opposite detachable clamp plate (321) secured to the peripheral flange (31) by means of a screw (301) fastened to the peripheral flange (31). The clamp plate (321) has a hooking plate (32') extending upwards therefrom. The flat panel (33) is seated on and abuts with the first end (101) of the upright support (10''), and has a pair of central overlapping holes (341) aligned with the hollow shaft (11) of the upright support (10''). The hooking plates (32, 32') are inwardly curved to engage in the second corner grooves (14') of the horizontal support (10'). One of the overlapping holes (341) is provided for the electric wires (100) passing therethrough.

The leg assembly has bases (50) made of a metal material. Each of the bases (50) is connected to the second end (102) of the upright support (10'') in order to uphold the upright support (10''). The base (50) has a bottom plate (51) with a hole (51''), and a pair of opposed blocks (51') formed thereon which have two end faces facing each other. Each of the end faces has a pair of protrusions (52) which respectively engage one of the first corner grooves (14) and one of the second (14') corner grooves of the upright support (10''). The base (50) has a pair of cushioning pads (A) mounted thereon.

The leg assembly has screw fasteners to fasten the bases (50), the upright supports (10'') and the connectors (30). Each of the screw fasteners includes a screw bolt (90) extending from the base (50) through the hole (51'') and passing through the hollow shaft (11) of the upright support (10'') and one of the holes (341) of the connector (30), out of the flat panel (33) of the connector (30) to engage a nut (90').

The leg assembly has end cover plates (80) made of a metal or a plastic material. Each of the end cover plates (80) has a cross-section substantially similar to the cross-section of the tubular member (10). The end cover plate (80) has four corner L-shaped protrusions (81) with projecting stubs (82). The end cover plate (80) is detachably fitted to and covers one of the first and second ends (101, 102) of the horizontal support (10'').

The leg assembly has rack bars (60) made of a metal material. Each of the rack bars (60) has two ends provided with two cushioning pads (A). One of the two ends has a bottom concave portion (61'), and a pair of opposite hooking plates (61) respectively extending and curved downwards from the concave portion (61') to engage in the first corner grooves (14) of the horizontal support (10').

Figure 2A:
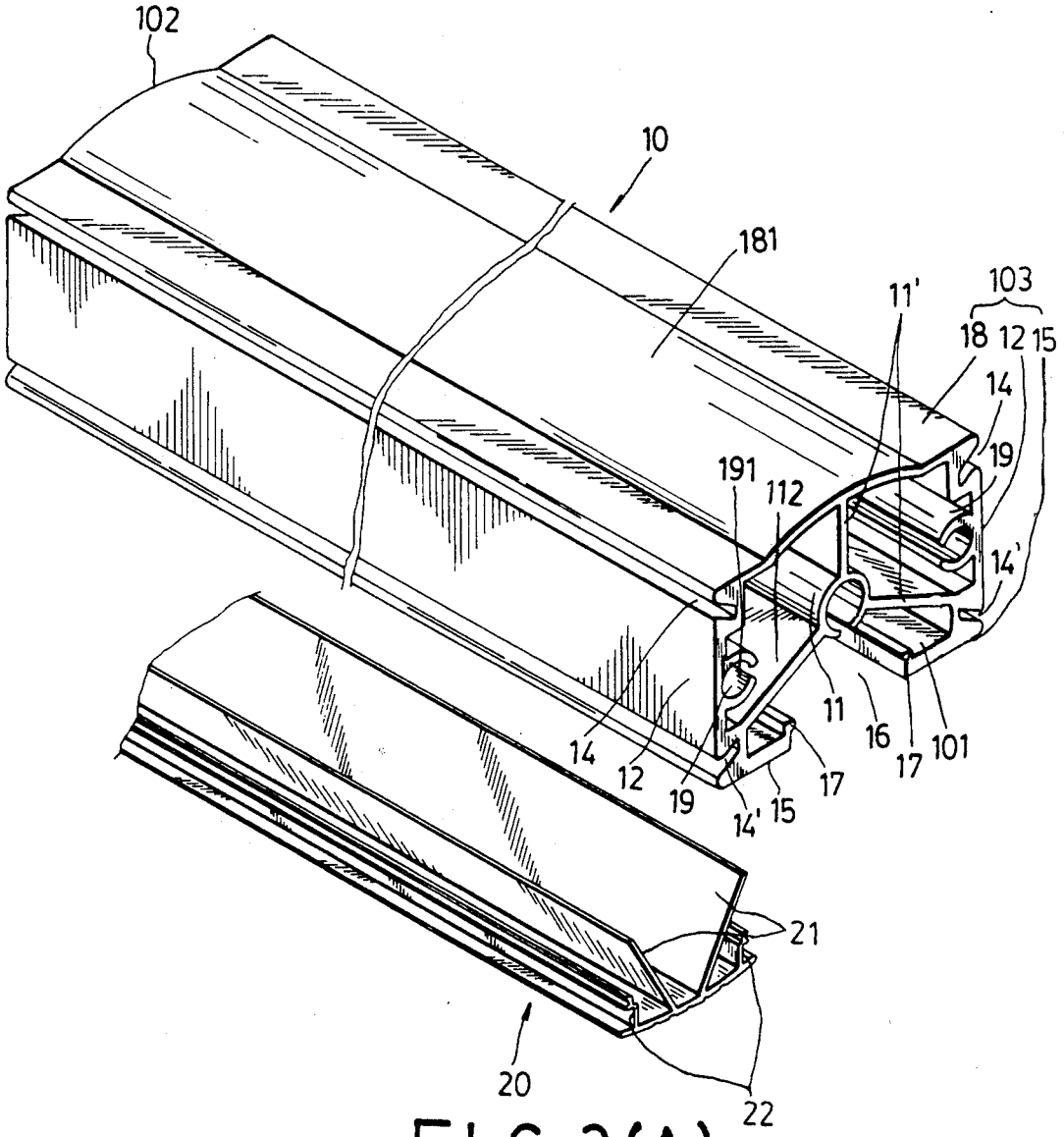
FIG. 2(A) is a perspective view of the support of the leg assembly.
Figure 2B:
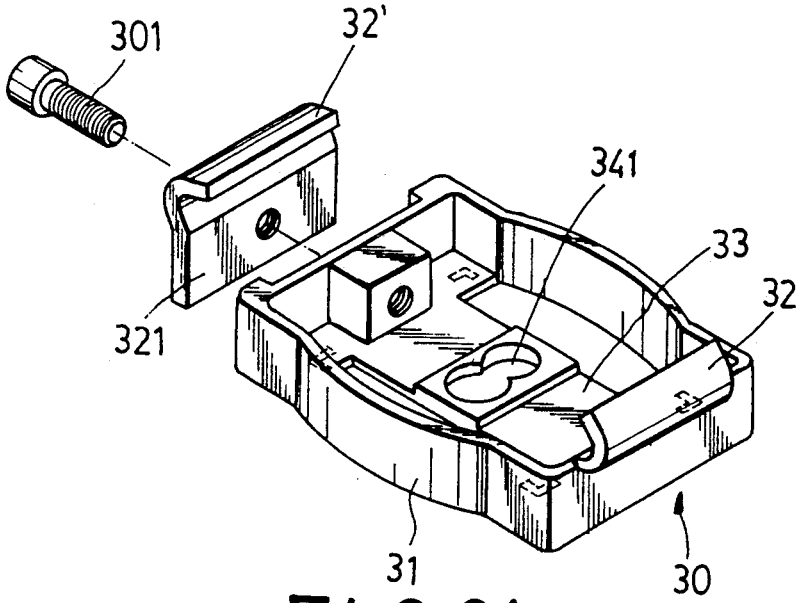
FIG. 2(B) is a schematic view of the connector of the leg assembly.
Figure 2C:
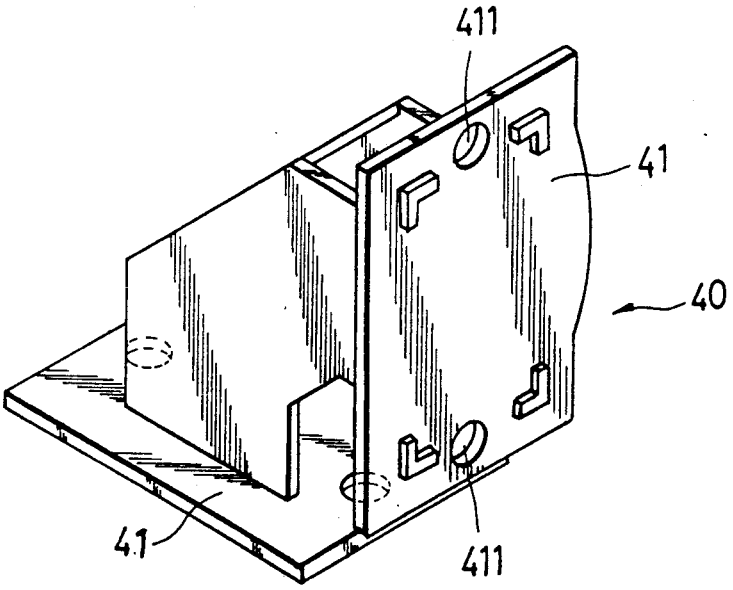
FIG. 2(C) is a schematic view of the corner connector of the leg assembly.
Figure 2D:
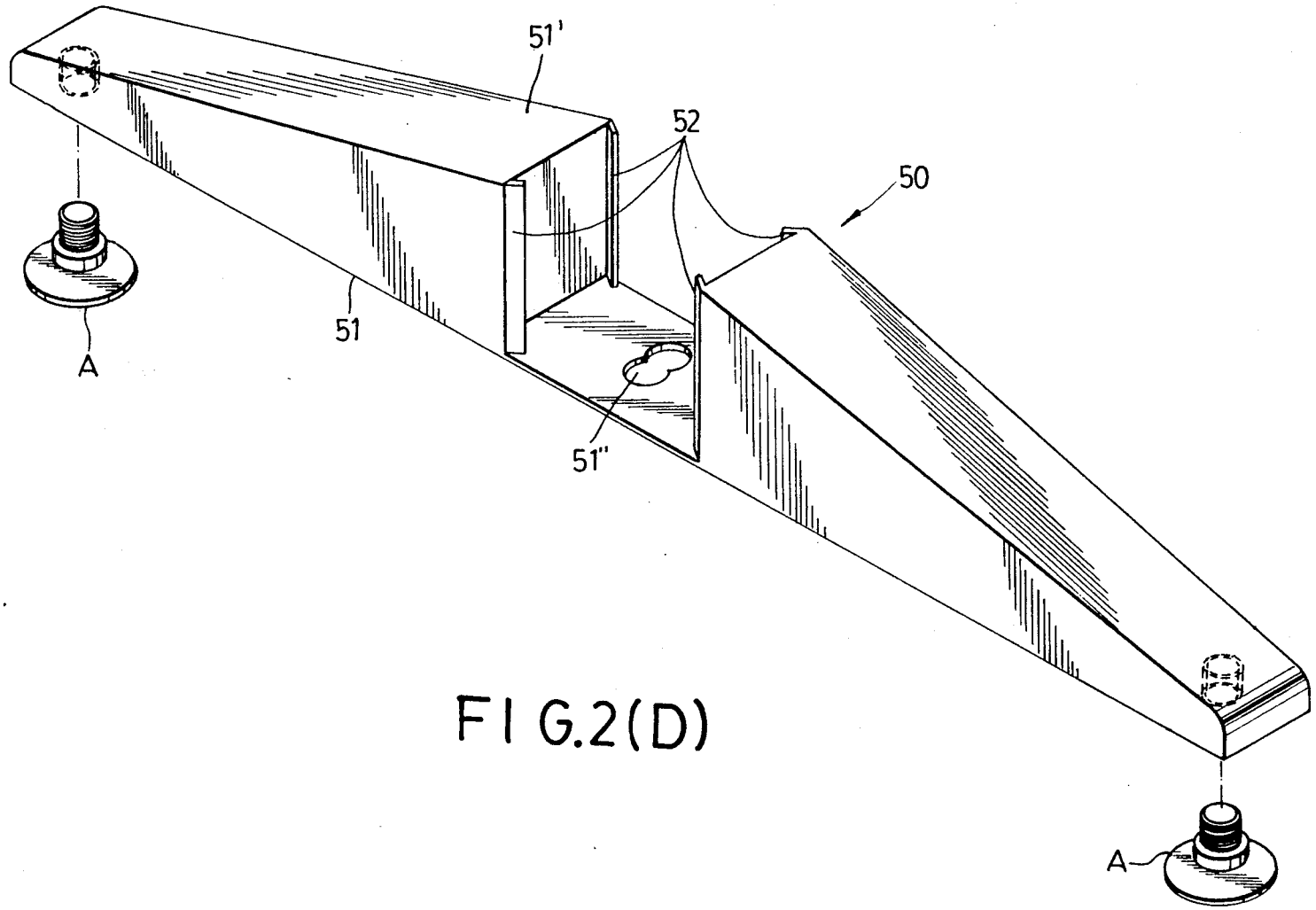
FIG. 2(D) is a schematic view of the base of the leg assembly.
Figure 2E:
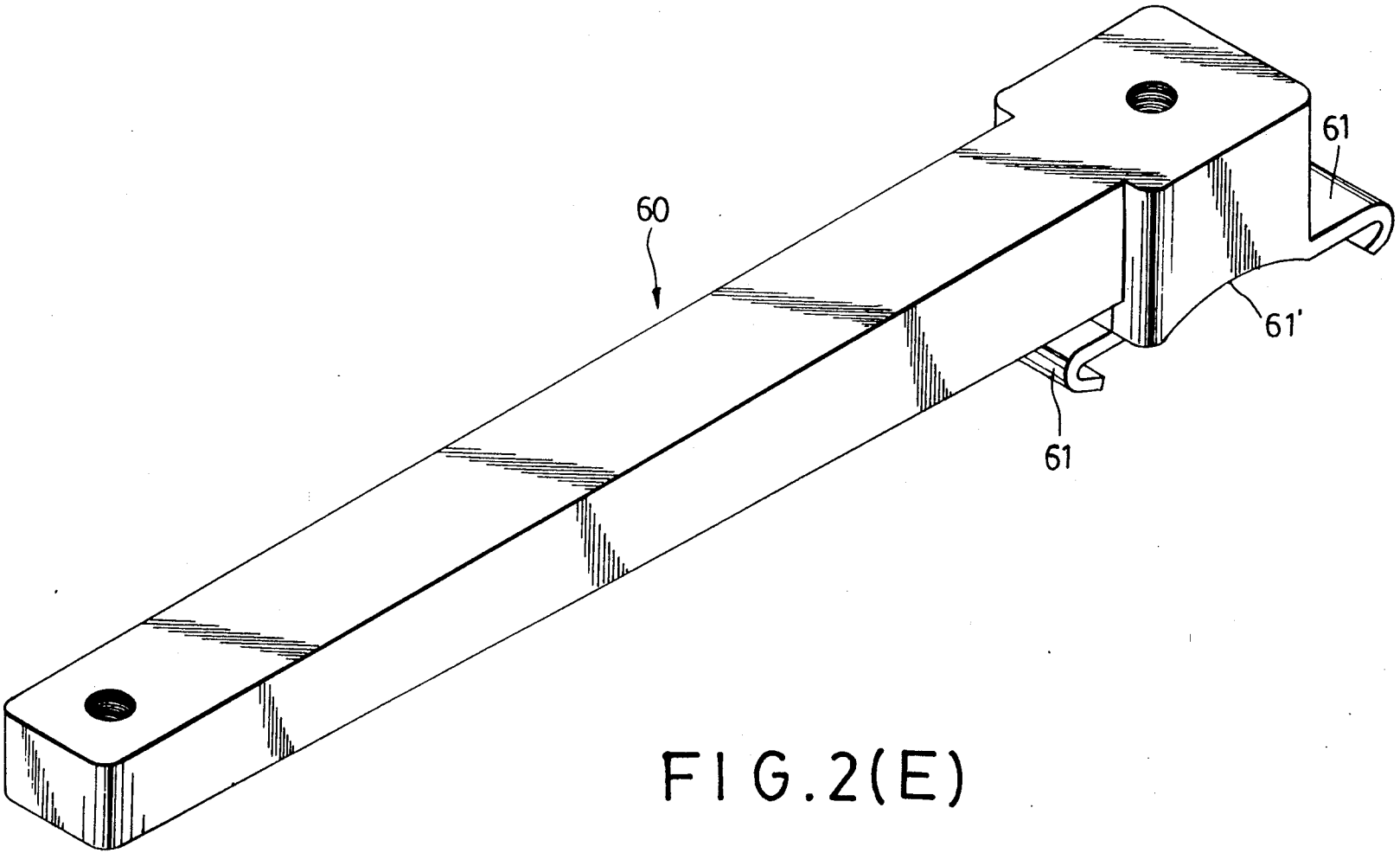
FIG. 2(E) is a schematic view of the rack bar of the leg assembly.
Figure 5:
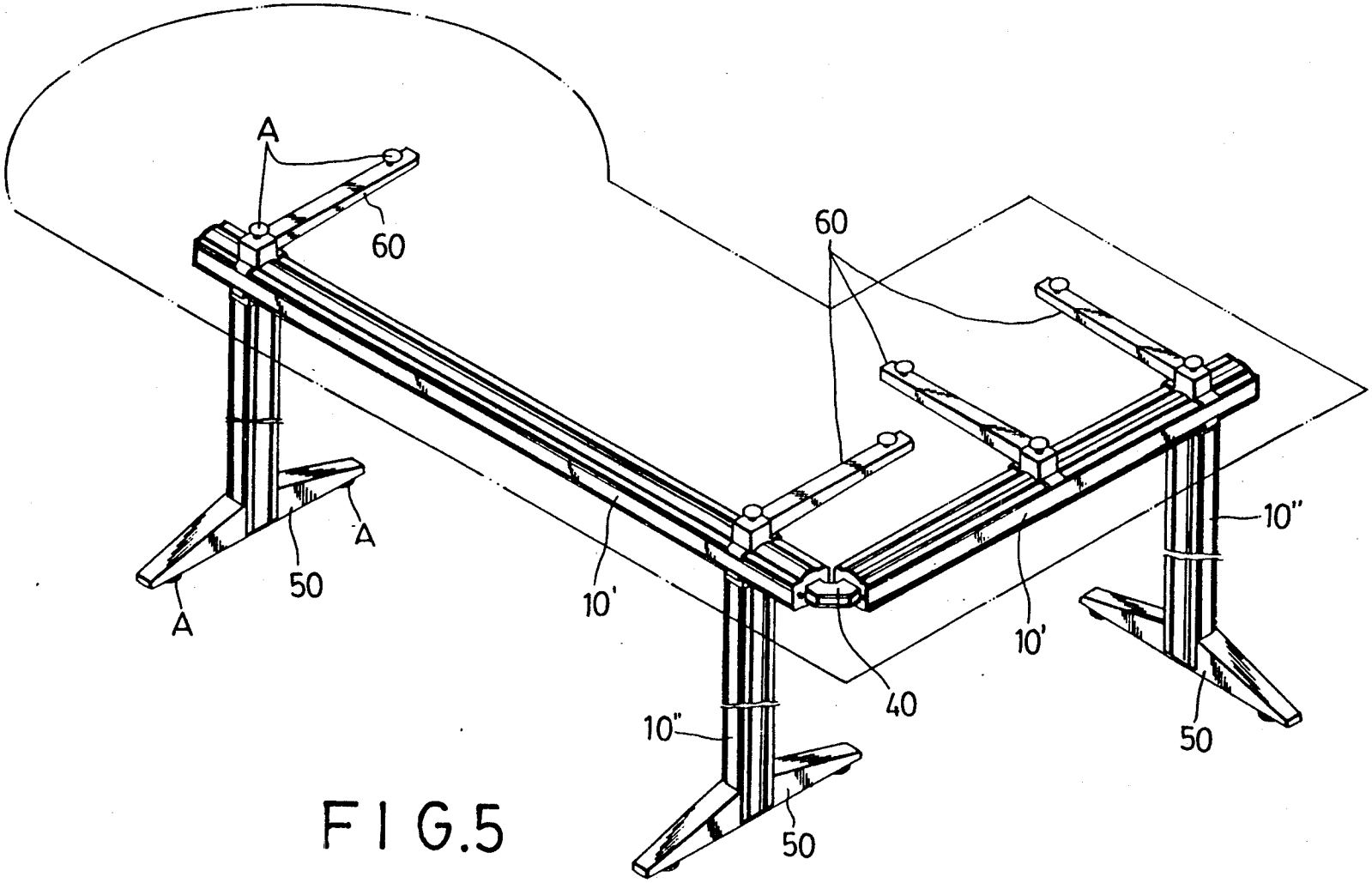
FIG. 5 is a schematic view of the leg assembly on which the glass plate is mounted.

Referring to FIGS. 2(C) and 5, the leg assembly has substantially L-shaped corner connectors (40) to interconnect the horizontal supports (10') forming an angle therebetween. Each of the corner connectors (40) has two connecting plates (41) which form an angle therebetween measuring 90 degrees, and each connecting plate has a pair of opposed engaging holes (411). Each of the connecting plates (41) is secured to one of the first and second ends (101, 102) of the horizontal supports (10') by means of screws (not shown) respectively passing through the engaging holes (411) of one of the connecting plates (41) and engaging in the interior C-shaped grooves (19).

Figure 2F:
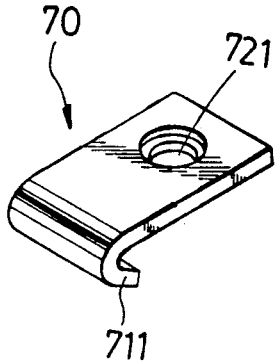
FIG. 2(F) is a schematic view of the attachment member of the leg assembly.
Figure 2G:
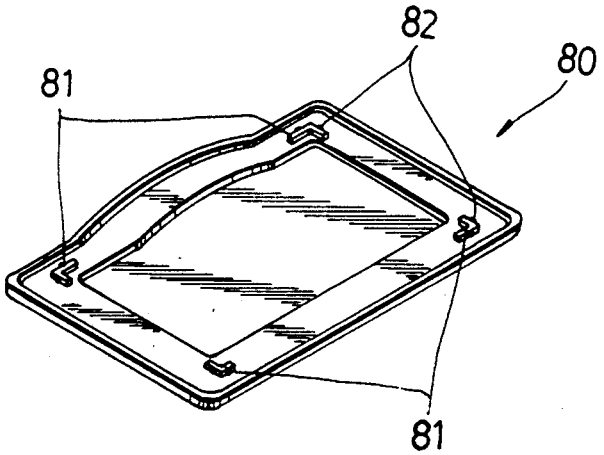
FIG. 2(G) is a schematic view of the end cover of the leg assembly.
Figure 3:
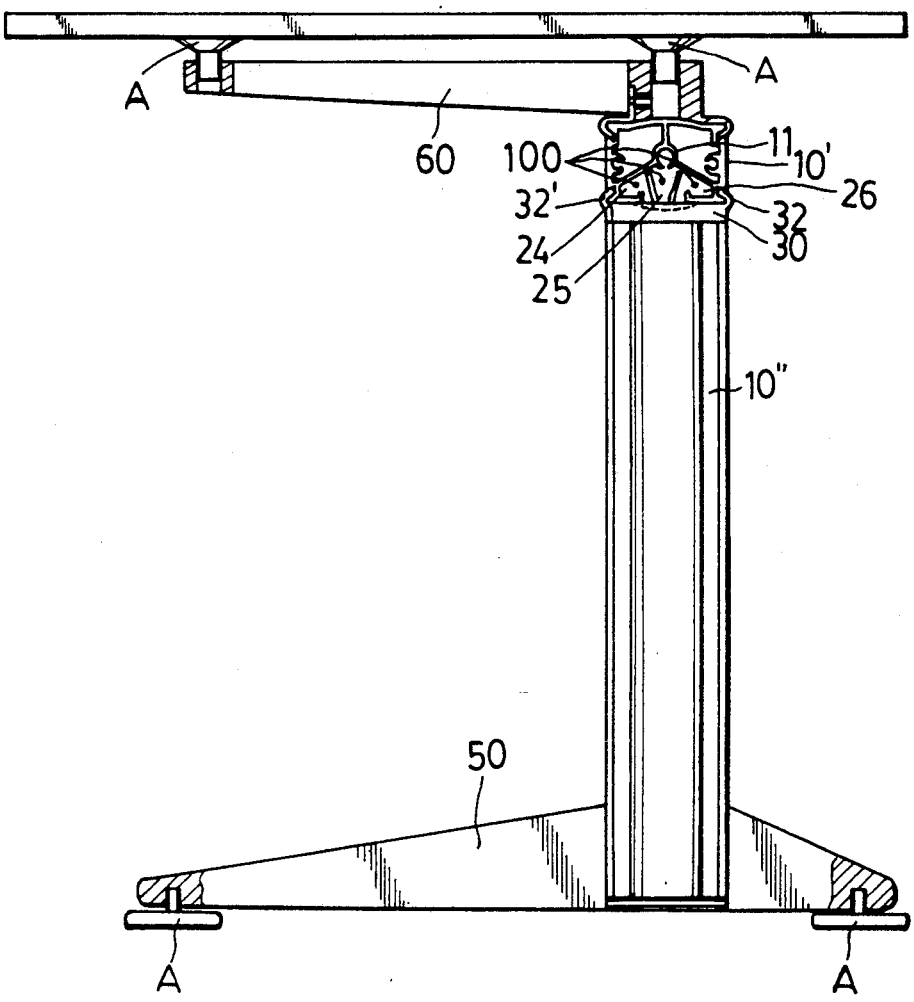
FIG. 3 is a partial sectional view of the leg assembly.
Figure 4:
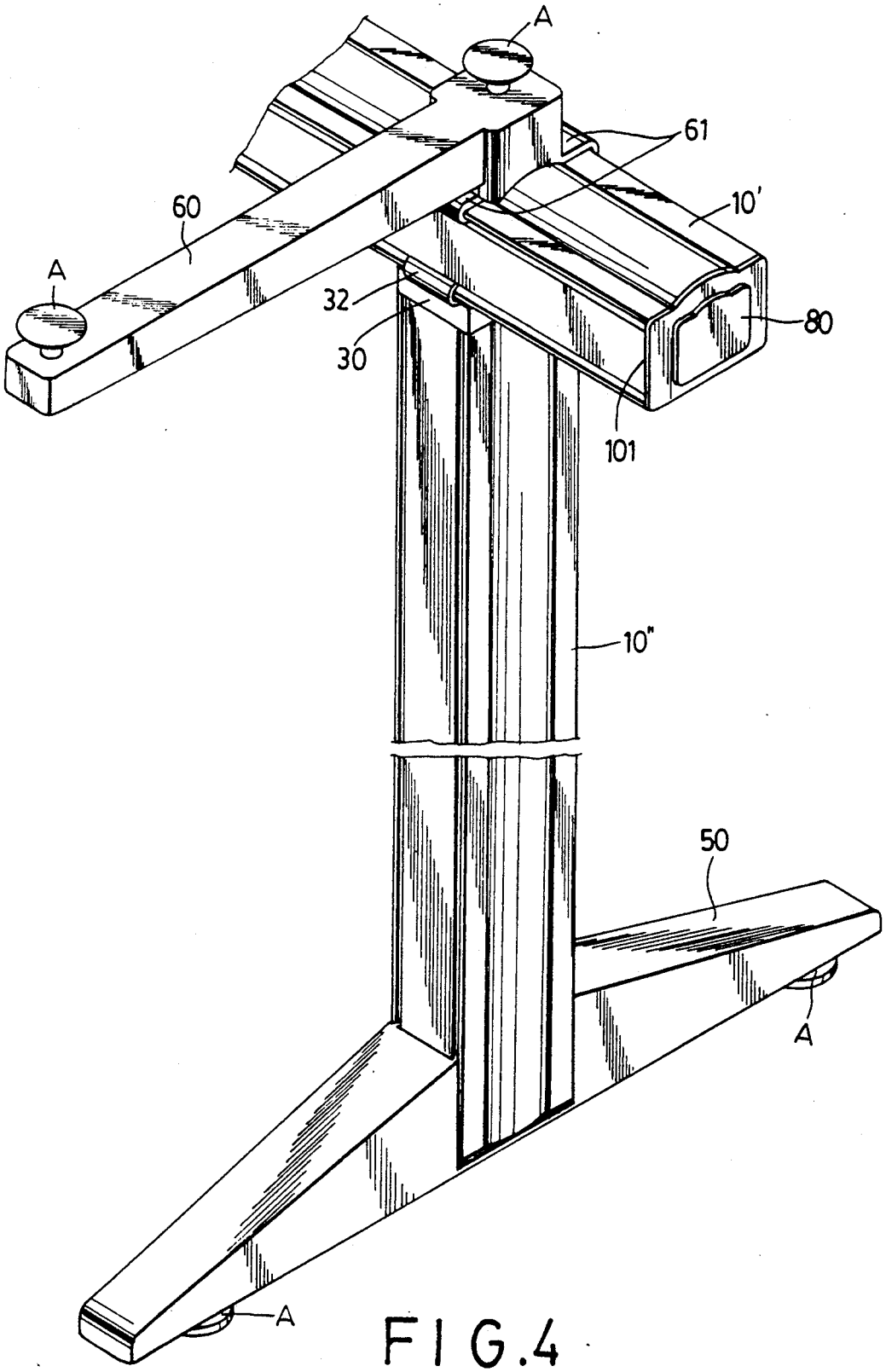
FIG. 4 is a partial schematic view of the leg assembly.
Figure 6:
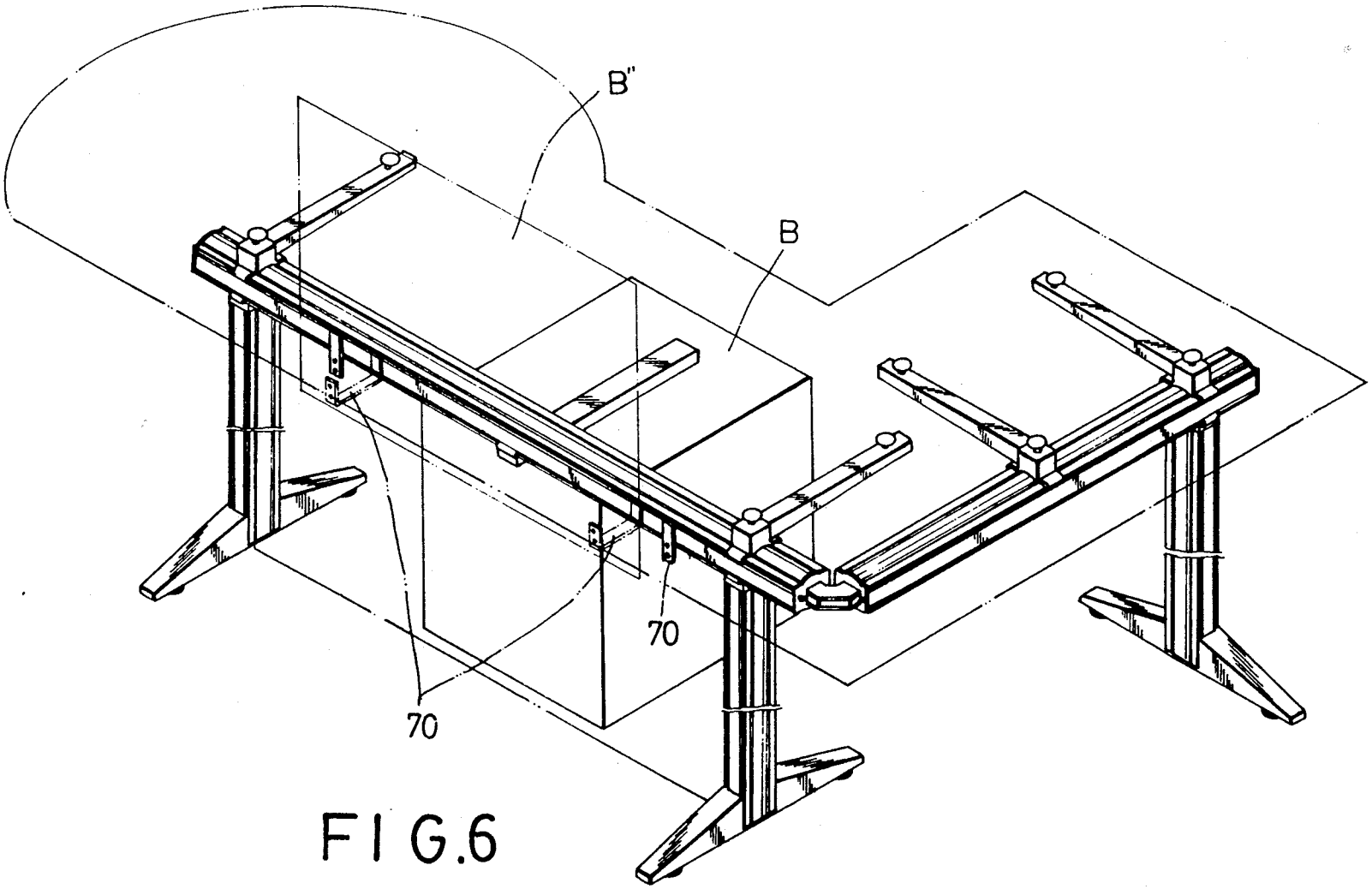
FIG. 6 is a schematic view of the leg assembly on which the glass plate and the drawer are mounted.

Referring to FIGS. 2(F) and 6, the leg assembly includes attachment members (70) made of a metal material. Each of the attachment members (70) includes a plate having a hooking portion (711) to engage in one of the first corner grooves (14) of the horizontal support (10'), and an engaging hole (721) formed thereon. The attachment member may be formed as a U-shape.

Figure 7:
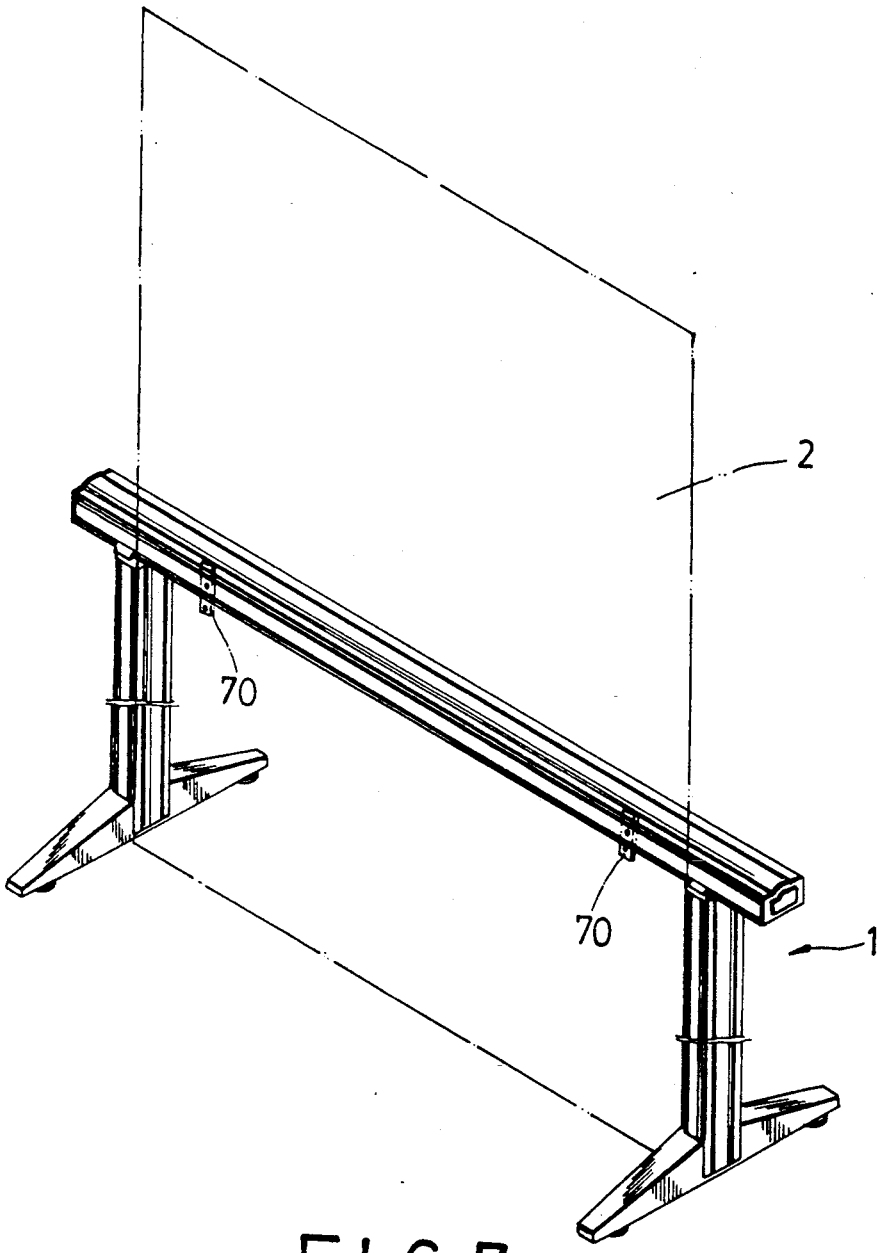
FIG. 7 is a schematic view of the leg assembly on which the partition plate is mounted.

The horizontal and upright supports (10', 10'') are manufactured in a uniform size. Referring to FIGS. 5 and 7, each of the horizontal and upright supports (10', 10'') can be easily cut into the desired size according to the user's needs, and the leg assembly can be conveniently assembled according to the user's needs. The leg assembly can be provided with a glass plate which is mounted on the rack bars (60), a drawer (B) and a partition plate (B'') which are respectively secured to the attachment members (70). FIG. 7 shows that another large partition plate (2) is secured to the attachment members (70) of the leg assembly to serve as a screen. Therefore, the leg assembly can be easily incorporated with the glass plate, the drawer, or the partition plate to serve as a desk, a partition, a cabinet or a screen. So, the cost of a piece of furniture which incorporates the leg assembly is less that that of the prior art.

While the present invention has been described in connection with what is considered the most practical and preferred embodiment, it is understood that this invention is not limited to the disclosed embodiment, but is intended to cover various arrangements included within the spirit and scope of the broadest interpretations and equivalent arrangements.

I claim:

1. A leg assembly for furniture comprising at least one horizontal support, at least one upright support having a top and a bottom end, at least one connector connecting said top end of said upright support to said horizontal support, and at least one base connected to said bottom end of said upright support to uphold said upright suuport, characterized by:

each of said horizontal and upright supports including a tubular member having a first end, an opposite second end, and a tubular wall extending between said first and second ends, said tubular wall including a first panel, an opposite second panel, a pair of opposite third panels respectively interconnecting said first and second panels, a pair of first longitudinal corner grooves extending between said first and second ends adjacent to said first panel, and a pair of second longitudinal corner grooves extending between said first and second ends adjacent to said second panel, said tubular member having an interior longitudinal hollow shaft and a plurality of reinforcing webs respectively and radially connected between said hollow shaft and said tubular wall;

said first end of said upright support defining said top end of said upright support, said second end of said upright support defining said bottom end of said upright support;

said connector including a panel which abuts said first end of said upright support and which has a hole aligned with said hollow shaft of said upright support, said connector having a pair of opposite hooking plates respectively extending upwards from said panel and being curved inwardly to engage in said second corner grooves of said horizontal support; and said leg assembly further comprising at least one screw fastener to fasten said base, said upright support and said connector, said fastener including a screw bolt extending from said base and passing through said hollow shaft of said upright support and said hole of said panel of said connector and out of said panel of said connector.

2. A leg assembly as claimed in claim 1 characterized in that said second panel of said tubular member of each of said horizontal and upright supports has a longitudinal opening extending from said first end to said second end to access the interior of said tubular member, and a longitudinal detachable cover plate made of an insulating material to close said opening, said detachable cover plate having a partition plate extending inwards therefrom.

3. A leg assembly as claimed in claim 2, characterized in that said second panel of said tubular member of each of said horizontal and upright supports has two longitudinally spaced peripheral edges adjacent to said opening, each of said peripheral edges having an inward and longitudinal rail formed therealong, said detachable cover plate having a pair of oppositely longitudinal projecting portions each of which has a longitudinal rail groove formed therealong, said rail grooves engaging said rails when said detachable cover plate closes said opening.

4. A leg assembly as claimed in claim 1, said base has a bottom plate and a pair of opposed blocks formed thereon, said opposed blocks having two end faces facing each other, each of said end faces having a pair of protrusions which respectively engage one of said first corner grooves and one of said second corner grooves of said upright support.

5. A leg assembly as claimed in claim 1, characterized in that said horizontal support further incudes an end cover plate which is detachably attached to and covers one of said first and second ends of said tubular member of said horizontal support.

6. A leg assembly as claimed in claim 1 which includes two horizontal supports forming an angle therebetween, characterized in that said leg assembly further comprises a substantially L-shaped corner connector to interconnect said two horizontal supports, said corner connector having two connecting plates forming an angle therebetween each of which is connected to one of said first and second ends of said two horizontal supports.

7. A leg assembly as claimed in claim 6, characterized in that said tubular member of each of said horizontal and upright supports has a pair of oppositely longitudinal interior C-shaped grooves respectively formed along said opposite third panels, each of said two connecting plates of said L-shaped corner connector having a pair of opposed engaging holes aligned with said interior C-shaped grooves of one of said two horizontal supports when said connecting plates of said corner connector engage said two horizontal supports.

* * * * *